United States Patent [19]

Vallee

[11] 4,193,242

[45] Mar. 18, 1980

[54] SHEET METAL ROOFING SYSTEM

[76] Inventor: Louis L. Vallée, 6392 Maubourg Ave., Montreal, Quebec, Canada, H1M 2C8

[21] Appl. No.: 895,080

[22] Filed: Apr. 10, 1978

[51] Int. Cl.[2] ..... E04D 3/366

[52] U.S. Cl. ..... 52/469; 52/463

[58] Field of Search ..... 52/463–469, 52/520, 543, 479

[56] References Cited

U.S. PATENT DOCUMENTS

| | | | |
|---|---|---|---|
| 2,855,871 | 10/1958 | Huntington | 52/469 X |
| 4,034,530 | 7/1977 | Vallee | 52/463 |

*Primary Examiner*—Karl Bell

*Attorney, Agent, or Firm*—Larson, Taylor and Hinds

[57] ABSTRACT

A roofing system of the batten type using sheet metal components only.

The battens are formed by folding the side edge portions of adjacent pan sections to form securing channels and upstanding side walls. The side walls are folded inwardly away from the securing channels and then downwardly to form downwardly projecting lips spaced inwardly and intermediate of the height of the side walls and a closure cap is slidable along the top edges of the side walls and in engagement with the downwardly projecting lips of adjacent pan sections to bridge and seal the gap formed between the adjacent side walls above the abutting securing channels, the securing channels being held down on the underlying roof structure by fastening screws.

3 Claims, 4 Drawing Figures

SHEET METAL ROOFING SYSTEM

This invention relates to sheet metal roofing systems and particularly to roofs of the batten type.

The invention is an improvement over the roofing systems disclosed in my U.S. Pat. No. 4,034,530 in which wood battens are laid on the roof undersurface and the roof undersurface and the battens are covered with a series of pan sections and batten caps. It is also an improvement on the system disclosed in my U.S. Pat. No. 4,014,152 in which the battens are in part formed on the edges of the pan sections and when the pan sections are joined together, the mating edges of the pan sections form complete battens without separate batten caps. In my previous U.S. Pat. No. 4,058,950 there is disclosed metal battens and pan sections in which upper edge portions of the metal battens are interlocked with edge portions of the pan sections and a batten cap encloses the interlocked battens and pan sections.

In the present invention, the side edges of the pan sections are formed to first provide upstanding side walls and then to provide securing channels located outwardly of the upstanding side walls. The upstanding side walls of the pan sections are each formed by bending the side edges of the sheet metal from which the pan sections are formed, first upwardly at right angles to the central area of the pan section, followed by bending the terminal portion of the sheet inwardly and then downwardly in the direction of the central portion of the pan section, then upwardly upon itself to form downwardly projecting lips lying parallel with and spaced from the first upwardly bent portion of the side wall. The terminal portions of the sheet are then bent outwardly away from the central portion of the pan section and then downwardly to lie in surface contact with the outer facing surface of the first upwardly bent portion of the side walls. The shorter remaining terminal portions of the sheet are then bent at right angles to form narrow outer base portions lying in the same plane as the central portion of the pan section and having their outer edge portions bent upwards so that the said outer base portions and said outer edge portions form securing channels located on the outer side of the sides walls. The outer edge portions of the securing channels of adjacent pan sections abut against each other and are held down on the underlying roof structure by fastening screws through the outer base portions. A cap member formed of sheet metal is slidably engaged over the top of adjacent side walls of the pan sections and with the downwardly projecting lips of the side walls and bridges and closes the gap between the adjacent side walls.

The object of the present invention is to provide a metal roof in which the mating edges of adjacent pan sections forming the roof covering have upstanding side walls and outwardly located channels for cheaper manufacture and faster assembly of the pan sections on a roof.

A further object of the invention is to provide pan sections having side securing channels which abut with the side securing channels of adjacent pan sections, and the pan sections are secured to the underlying roof structure by fastening screws passed through the side securing channels.

A further object of the invention is to provide a metal roof formed of pan sections having upstanding side walls and a cap member also of sheet metal is slidably engaged with the adjacent side walls of adjacent pan sections.

These and other objects of the invention will be apparent from the following detailed specification and the accompanying drawings in which.

Figure 2:
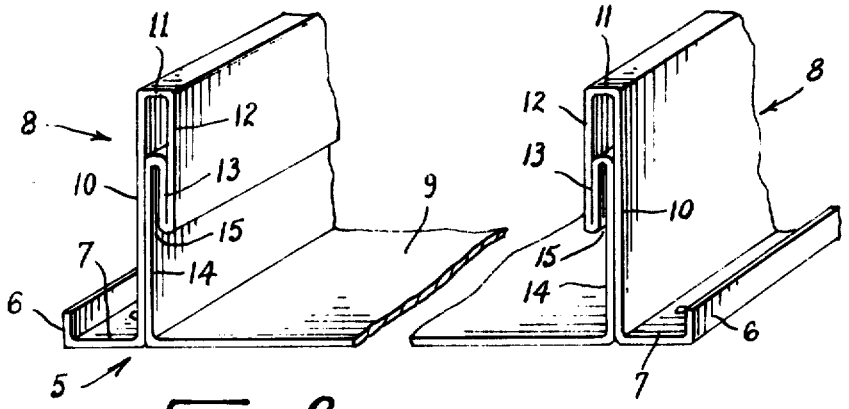
FIG. 2 is a transverse section of an intermediate pan section.

Referring to the drawings and particularly to FIG. 2, each intermediate pan section 5 has its opposite side edges formed as a securing channel with a shallow upstanding outer edge 6 and a relatively narrow outer base portion 7. Upstanding side walls 8 are spaced apart from each other by the relatively wide central base portion 9 of the pan section.

The upstanding side walls 8 are each formed by folding the sheet of metal from which the pan section 5 is formed to form an outer wall member 10, and a top edge portion 11 projected inwardly of the wall member 10. The sheet is then folded downwardly to form a wall member 12 and then folded upwardly and inwardly of the wall member 12 to form a downwardly projecting lip 13. The sheet is then further folded downwardly to form the wall member 14 which lies in surface contact with the wall member 10 and in spaced relation to the downwardly projecting lip 13 to leave a gap 15 which has a width equal to the thickness of the sheet of metal from which the pan section is formed.

Figure 3:
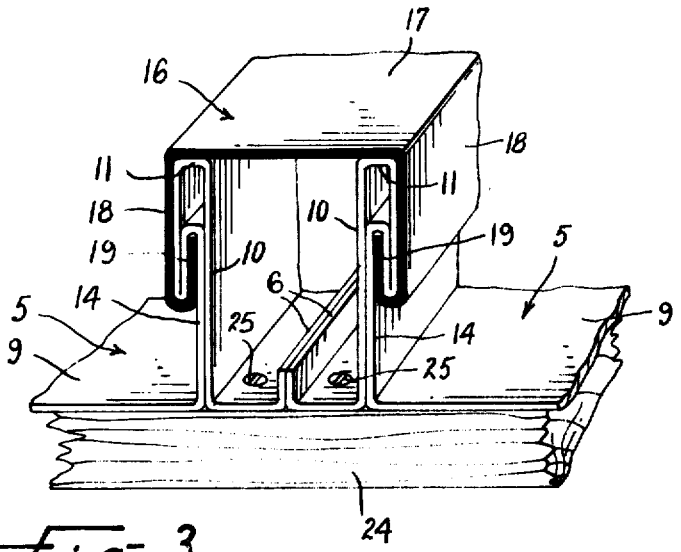
FIG. 3 is a transverse section of assembled adjacent edge portions of two pan sections, together with a cap to complete the batten structure, and showing abutting channels held down on a roof understructure by fastening screws.

The batten closure cap 16, shown in FIG. 3, is generally of inverted U-shape, having a top member 17, outer side members 18 whose lower edges are upturned to form the inner side members 19 which are spaced apart from the outer side members 18 a distance equal to twice the thickness of the sheet from which the pan section is formed.

Figure 1:
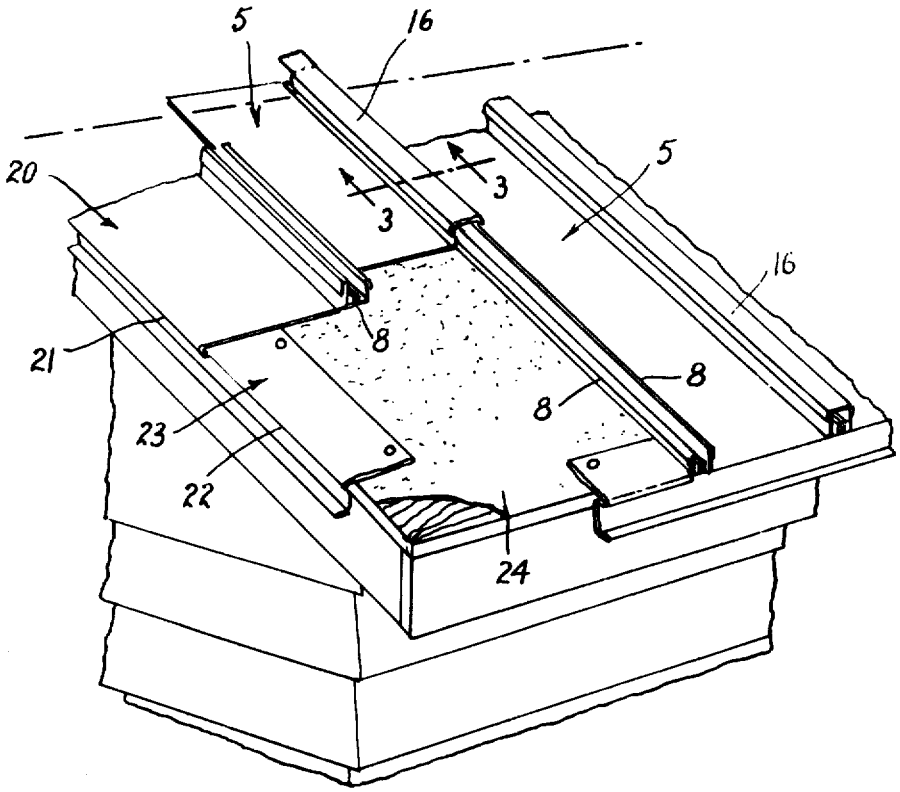
FIG. 1 is a perspective view of a corner portion of a sloping roof with a metal roofing system according to the present invention, some of whose parts have been removed or cut away for illustrative purposes.
Figure 4:
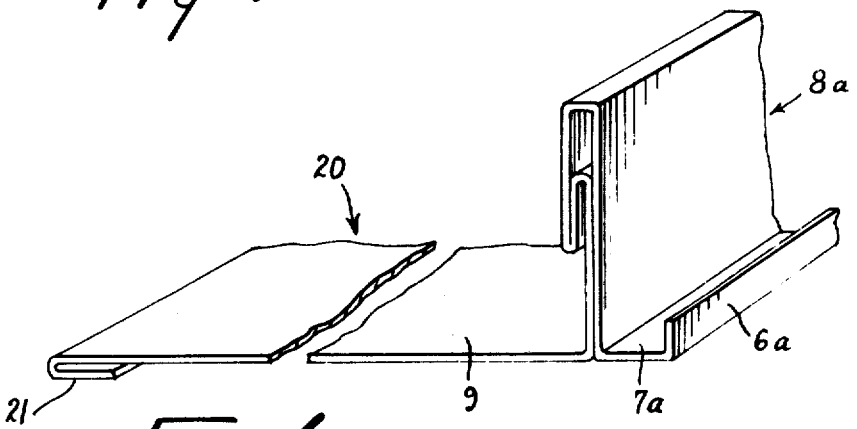
FIG. 4 is a transverse section of an end pan section.

The outer pan sections 20, shown in FIG. 4, are provided on one edge only with an upstanding side wall **8*a* similar to the side walls 8 shown in FIG. 2, complete with the channel formed by the members 6*a* and 7*a*. The opposite side edge of the pan section 20 is inturned downwardly at 21 to engage with the protruding flange 22 of the gable starter 23, as shown in FIG. 1**.

The pan sections 5 and 20 are laid on the roof understructure 24 with their outer edge upturned members 6 abutting each other and are secured to the roof understructure 24 by the fastening screws 25 passing through the members 7.

The assembly of the closure cap 16 with the upstanding side walls 8 of two adjacent pan sections 5, or with adjacent side walls 8 and **8*a*, is accomplished by sliding the closure cap 16 so that the top member 17 is in contact with the members 11 of adjacent side walls, and its side members 19 slide in the gap 15 between the downwardly projecting lips 13 and the wall members 14. Thus all of the members 10, 14 and 13 of the pan sections combine with the members 18 and 19 of the closure cap 16 to form very rigid side walls of the final batten structures. The final batten structures are further held rigid by the fact that members 6 snd 7 together form channels which abut each other, as shown in FIG. 3, and are held down by the fastening screws 25**.

With the above described sheet metal roof, the pan sections are laid side-by-side on the roof understructure and are secured in place by the screws 25 which are accessible only through the gap between adjacent upstanding side walls 8 and 8*a*. When the pan sections are secured in place and the battens are complete by sliding the caps 16 into engagement with the side walls 8 and 8*a*, the formed battens although of light weight are rigid enough to resist displacement by any outside forces.

The embodiments of the invention in which an exclusive property or privilege is claimed are defined as follows:

1. A metal roofing system of the batten type having a series of pan sections, each pan section formed of a single piece of pre-folded sheet metal having an elongated central base portion, two upstanding side walls, and a securing channel located outwardly of each upstanding side wall; each upstanding side wall having an inner member and an outer member, the said inner member being shorter in height than the outer member and in close contact with the outer member upwards from the said central base portion of the pan section, the said side wall members being folded inwardly and downwardly to form a lip spaced from the said side wall members; the said sheet metal being bent outwardly at the lower edge of the outer member of each side wall to form a said securing channel including an outer base portion lying in the plane of the central base portion and an outer edge portion bent upwardly a short distance at right angles to the outer base portion, each securing channel having in its outer base portion a series of apertures to receive securing means; means to secure the said securing channels to an underlying roof structure with the said outer edge portion of each securing channel of one pan section abutting the outer edge portion of a securing channel on an adjacent pan section; and a series of caps, each cap engaging with, said bridging the gap between, the facing sidewalls of adjacent pan sections.

2. A metal roofing system as set forth in claim 1 in which the lip formed in the said side walls is located intermediate the height of the side walls.

3. A metal roofing system as set forth in claim 1 in which each cap is of inverted U-shape, the side members of the U-shaped cap having their edge portions bent inwardly and upwardly to slidably engage between the said lips and the said wall members.

* * * * *